US012365375B2

(12) United States Patent
Vrba

(10) Patent No.: US 12,365,375 B2
(45) Date of Patent: Jul. 22, 2025

(54) VEHICLE AND ROUTE MONITORING SYSTEM

(71) Applicant: Transportation IP Holdings, LLC, Norwalk, CT (US)

(72) Inventor: Matthew Vrba, Marion, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 428 days.

(21) Appl. No.: 17/505,240

(22) Filed: Oct. 19, 2021

(65) Prior Publication Data

US 2023/0117899 A1 Apr. 20, 2023

(51) Int. Cl.

| | |
|---|---|
| ***B61L 27/20*** | (2022.01) |
| ***B61L 25/02*** | (2006.01) |
| ***B61L 27/04*** | (2006.01) |
| ***B61L 27/70*** | (2022.01) |

(52) U.S. Cl.

CPC ..... *B61L 27/20* (2022.01); *B61L 25/021* (2013.01); *B61L 25/023* (2013.01); *B61L 27/04* (2013.01); *B61L 27/70* (2022.01); *B61L 2201/00* (2013.01); *B61L 2205/00* (2013.01)

(58) Field of Classification Search

CPC ..... B61L 27/20; B61L 27/70; B61L 27/04; B61L 25/021; B61L 25/023; B61L 2201/00; B61L 2205/00

See application file for complete search history.

(56) References Cited

U.S. PATENT DOCUMENTS

| | | | | |
|---|---|---|---|---|
| 9,616,905 | B2 * | 4/2017 | Kernwein | B61L 25/023 |
| 11,148,692 | B2 * | 10/2021 | Bramucci | B61L 25/028 |
| 11,345,377 | B2 * | 5/2022 | Kernwein | B61L 15/009 |
| 11,867,521 | B2 * | 1/2024 | Trangbaek | B60W 40/105 |
| 2020/0001906 | A1 | 1/2020 | Bramucci et al. | |
| 2021/0403062 | A1 * | 12/2021 | Bramucci | B61L 3/125 |
| 2022/0108262 | A1 * | 4/2022 | Cella | G05B 17/02 |
| 2022/0119020 | A1 * | 4/2022 | Thiyagarajan | B61L 15/0072 |
| 2023/0117899 | A1 * | 4/2023 | Vrba | B61L 15/0027 701/2 |

* cited by examiner

*Primary Examiner* — Peter D Nolan
*Assistant Examiner* — Wae L Louie
(74) *Attorney, Agent, or Firm* — K&L Gates LLP

(57) ABSTRACT

A system is provided that may include a controller having one or more processors. The one or more processors may control movement of a vehicle system along a route, and determine a restriction in speed of the vehicle system at a switch point. The one or more processors may determine a direction of movement of the vehicle system based on the restriction in the speed at the switch point.

21 Claims, 5 Drawing Sheets

VEHICLE AND ROUTE MONITORING SYSTEM

BACKGROUND

Technical Field

The subject matter described relates to systems and methods that monitor vehicle systems and routes of vehicle systems.

Discussion of Art

A positive vehicle control (PVC) system is a monitoring system that monitors the locations of numerous vehicles in a network of routes and communicates with the vehicles to prevent collisions or other unsafe traveling conditions. PVC systems operate by determining which segments of routes are occupied by vehicles, are undergoing maintenance, or the like, and generate signals that inform the respective vehicles as to whether the vehicles can enter into certain route segments. Without receiving such a signal, the PVC system prevents entry of the respective vehicle from entering a route segment.

Often vehicle systems that utilize PVC systems are rail vehicles that travel along a network of interconnecting tracks that utilize switches to change the direction of the vehicle system onto a different track. When utilizing a switch, it is important to understand the alignment of each switch. While some switches are electronically monitored by wayside devices and the switch alignment is received by an on-board vehicle controller, in many instances, switches are not electronically monitored. Instead, a crew member of the vehicle system must observe the information and manually input the switch position into the vehicle controller. If the crew member fails to do so, the vehicle system may be stopped as a safety measure, and thereby cause significant inefficiencies.

One solution to having a crew member provide the switch alignment is to monitor heading data of the vehicle system and then attempt to match the heading signature to a known route signature. Still, there are a variety of switch types deployed in rail networks, each with different frog angles, lengths of track between a point of the switch and the half point of a frog angle, etc., each of which can make determining the switch position difficult. Thus, a need may exist for systems and methods that can determine or otherwise obtain switch alignments to improve the efficiencies by which vehicle systems travel.

BRIEF DESCRIPTION

In accordance with one embodiment, a system is provided that may include a controller having one or more processors that may control movement of a vehicle system along a route and to determine a restriction in speed of the vehicle system at a switch point. The one or more processors may determine a direction of movement of the vehicle system based on the restriction in the speed at the switch point.

In accordance with one embodiment, a method is provided and may include receiving, with a vehicle controller, communication from a positive vehicle controller at a remote location, and determining a restriction in speed of a vehicle system at a switch point on a route based on the communication from the positive vehicle controller. The method may include determining a direction of movement of the vehicle system at the switch point based on the restriction in the speed at the switch point.

In accordance with one embodiment, a system is provided that may include a vehicle system with a vehicle controller having one or more processors. The one or more processors may receive communications from a positive vehicle controller remote from the vehicle system related to a restriction in speed of the vehicle system, and obtain the restriction in the speed of the vehicle system at a determined location on a route. The one or more processors may determine a direction of movement of the vehicle system at the determined location based on the restriction in the speed at the determined location of the route.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to systems and methods that monitor vehicle systems, and routes of vehicle systems to determine the direction, or heading of the vehicle system at switch points. Switch points are locations on a route when a vehicle system has an option to stay on a first route, or change to a second route. For rail vehicles, a switch is provided at a switch point and is a physical device that moves the track between the first route and second route. A PVC, or positive train control (PTC) is utilized in association with vehicle systems to restrict movement (e.g., provide a speed limit) at the switch point when the vehicle systems move from the first route to the second route. Based on a speed restriction at the switch point, a determination is made by the control system related to the switch type at the switch point. In particular, because the speed restriction related to the switch point is dependent on the geometry of the first route and second route at the switch point, by utilizing the speed restriction (e.g. reduction in speed from 70 miles per hour (mph) to 50 mph, or from 70 mph to 30 mph), the switch type may be determined.

Not all embodiments described herein are limited to rail vehicle systems or PVC systems. For example, one or more embodiments of the systems and methods described herein can be used in connection with other types of vehicles, such as automobiles, trucks, buses, mining vehicles, marine vessels, aircraft, agricultural vehicles, or the like. As another example, one or more embodiments can be used with vehicle control systems other than PVC systems to change movement of a vehicle. For example, a negative vehicle control system could be utilized to change the movement of a vehicle. To this end, in one example, the methods and systems described herein may be utilized for controlling autonomous vehicles.

Figure 1:
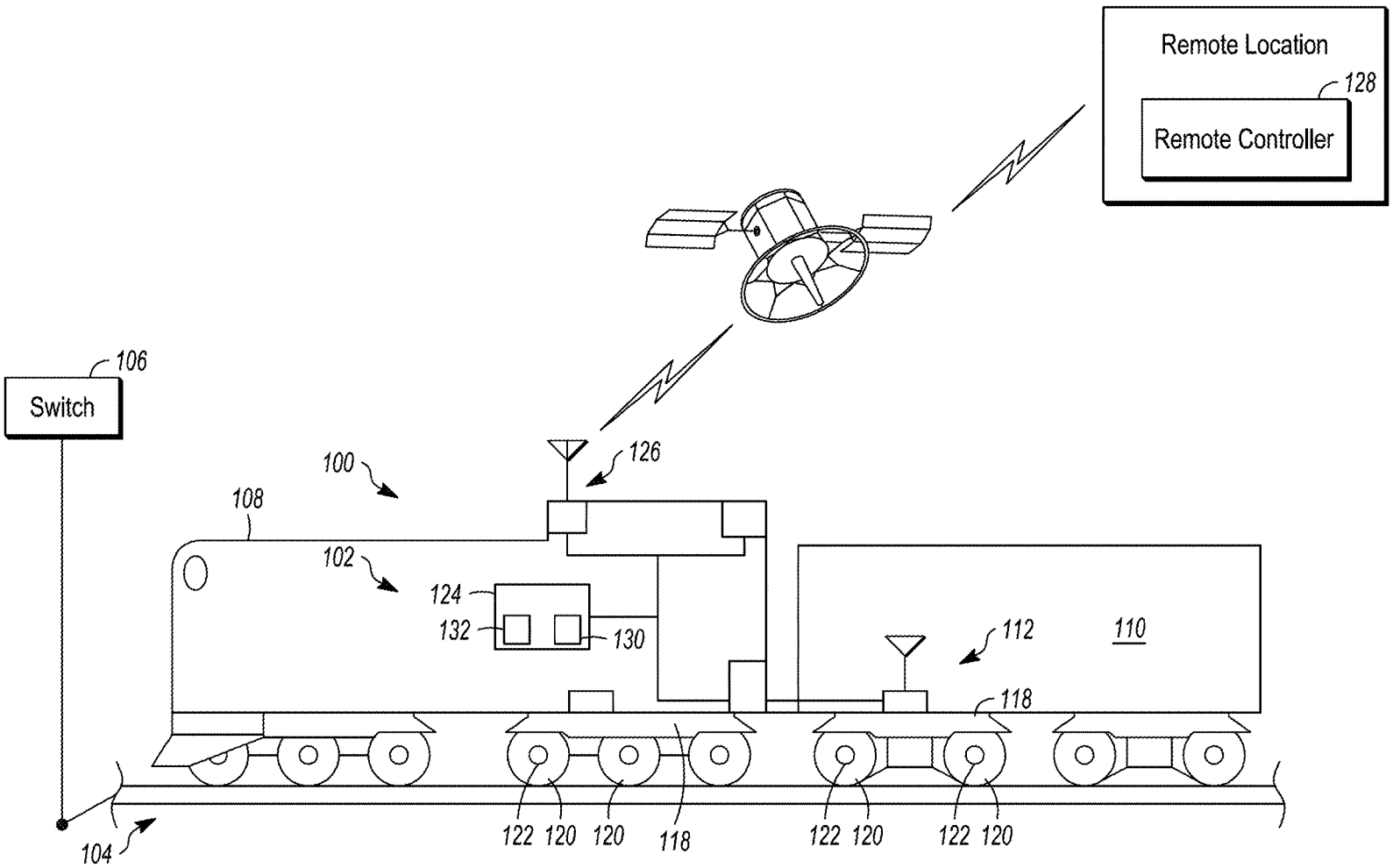
FIG. 1 illustrates a block schematic diagram of a vehicle system.

FIG. 1 illustrates a schematic diagram of one example of a vehicle system 100 that includes a control system 102. The vehicle system may travel along a route 104 on a trip from a starting or departure location to a destination or arrival location. In one example, the route may include a switch 106 for determining the direction of travel for the vehicle system at a switch point. A switch point includes a location on a route that includes a branch, or second route extending from a first, or main route, that continues after the switch point. For example, a switch point may be an intersection between routes or located at such an intersection. In one example, the route that a vehicle system initially travels may be considered a facing leg, and at a switch point the vehicle system can stay on the first route, or move onto a second route. The portion of the first route utilized if the vehicle system stays on the first route may be considered a normal leg, while the second route may be considered a reverse leg. While a switch is a term utilized to describe a device at a switch point for rail vehicles when the route is along tracks, the term switch point can refer to other routes and vehicle systems. For example, for an automobile, when a highway has an exit ramp, the beginning of the exit ramp is a switch point. At the switch point, the automobile can continue traversing on the highway and not take the exit ramp, or alternatively can take the exit ramp.

The vehicle system includes a propulsion-generating vehicle 108 and a non-propulsion-generating vehicle 110 that are mechanically interconnected to one another to travel together along the route. The vehicle system may include at least one propulsion-generating vehicle and optionally, one or more non-propulsion-generating vehicles. Alternatively, the vehicle system may be formed of only a single propulsion-generating vehicle.

The propulsion-generating vehicle may generate tractive efforts to propel (for example, pull or push) the vehicle system along routes. The propulsion-generating vehicle includes a propulsion subsystem, such as an engine, one or more traction motors, and/or the like, that operate to generate tractive effort to propel the vehicle system. Although one propulsion-generating vehicle and one non-propulsion-generating vehicle are shown in FIG. 1, the vehicle system may include multiple propulsion-generating vehicles and/or multiple non-propulsion-generating vehicles. In an alternative embodiment, the vehicle system only includes the propulsion-generating vehicle such that the propulsion-generating vehicle is not coupled to the non-propulsion-generating vehicle or another kind of vehicle. In yet another embodiment, the vehicles in the vehicle system are logically or virtually coupled together, but not mechanically coupled together.

In the example of FIG. 1, the vehicles of the vehicle system each include multiple wheels 120 that engage the route and at least one axle 122 that couples left and right wheels together (only the left wheels are shown in FIG. 1). Optionally, the wheels and axles are located on one or more trucks or bogies 118. Optionally, the trucks may be fixed-axle trucks, such that the wheels are rotationally fixed to the axles, so the left wheel rotates the same speed, amount, and at the same times as the right wheel. In one embodiment, the vehicle system may not include axles, such as in some mining vehicles, electric vehicles, etc.

A vehicle controller 124 may be provided that includes a wireless communication system 126 that allows wireless communications between vehicles in the vehicle system and/or with remote locations, such as the remote (e.g., dispatch) location 128. The remote locations include off-board controllers such as back office system controllers and vehicle dispatch controllers. In one example, the controller at the remote location may be a PVC controller, a controller with PVC protocols, a PVC database, in communication with a PVC controller or database, or the like. The vehicle controller may include a receiver and a transmitter, or a transceiver that performs both receiving and transmitting functions. The vehicle controller may include an antenna and associated circuitry.

The vehicle controller may include a PVC system 130. A PVC system is a monitoring system utilized by a vehicle system to allow the vehicle system to move within a designated restricted manner (such as above a designated penalty speed limit, to enter another route segment, etc.) only responsive to receipt or continued receipt of one or more signals (e.g., received from off-board the vehicle) that meet designated criteria, e.g., the signals have designated characteristics (e.g., a designated waveform and/or content), are received at designated times (or according to other designated time criteria), and/or under designated conditions. For example, the vehicle may be automatically prevented from entering into another route segment unless a signal is received by the PVC system indicating that the other route segment does not include any other vehicles, may be automatically prevented from moving at speeds above a speed limit when a route segment has a maintenance crew present, etc. This is opposed to 'negative' vehicle control systems where a vehicle is allowed to move unless a signal (restricting movement) is received.

The vehicle controller may include a trip characterization element 132. The trip characterization element may provide information about the trip of the vehicle system along the route. The trip information may include route characteristics, designated locations, designated stopping locations, schedule times, meet-up events, directions along the route, and the like. For example, the designated route characteristics may include grade, elevation, slow warnings, environmental conditions (e.g., rain and snow), curvature information, speed restrictions including as a result of entering residential area and as a result of changing routes at a switch point, maintenance history, repair and health status, environmental features, features and characteristics of the route itself, etc. The trip information concerning schedule times may include departure times and arrival times for the overall trip, times for reaching designated locations, and/or arrival times, break times (e.g., the time that the vehicle system may be stopped), and departure times at various designated stopping locations during the trip.

The trip characterization element may include vehicle control setting for the trip, including throttle settings, dynamic braking settings, etc. The trip characterization element may be a database stored in an electronic storage device, or memory. The information in the trip characterization element may be input via the user interface device by an operator, may be automatically uploaded, or may be received remotely via the communication system. The source for at least some of the information in the trip characterization element may be a trip manifest, a log, or the like.

Figure 2:
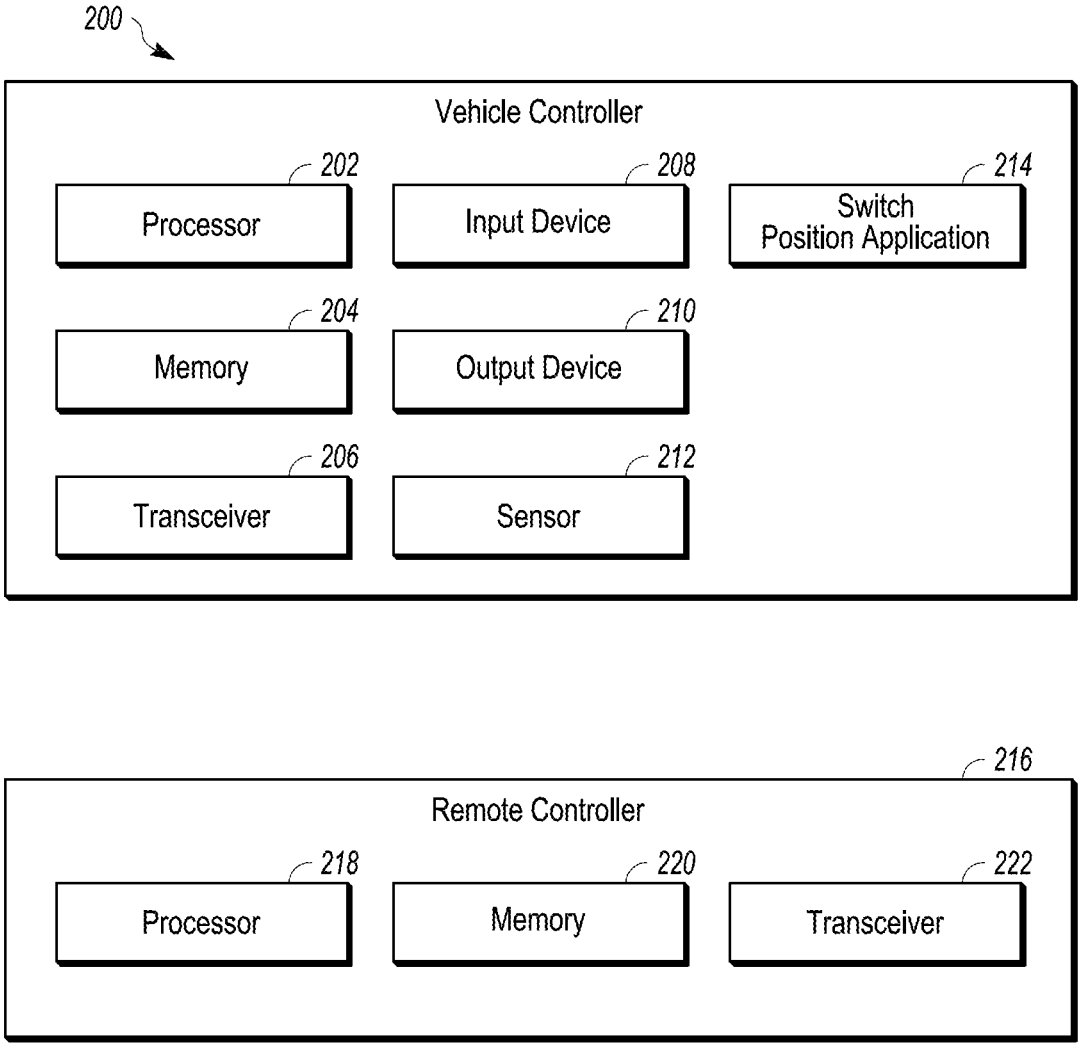
FIG. 2 illustrates block schematic diagram of a controller.

FIG. 2 provides a schematic illustration of a vehicle controller 200 that may control operation of a propulsion-generating vehicle. In one example, the vehicle controller represents the vehicle controller in FIG. 1. The vehicle controller may be a device that includes one or more processors 202 (microprocessors, integrated circuits, field programmable gate arrays, etc.).

The vehicle controller optionally may include a memory 204, which may be an electronic, computer-readable storage device or medium. The memory may be within the housing of the controller, or alternatively may be on a separate device that may be communicatively coupled to the controller and the one or more processors therein. By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. The memory can include a tangible, non-transitory computer-readable storage medium that stores data on a temporary or permanent basis for use by the one or more processors. The memory may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like.

The vehicle controller may include a transceiver 206. The transceiver may be a single unit or be a separate receiver and transmitter. In one example, the transceiver may only transmit signals.

The vehicle controller may include an input device 208 and an output device 210. Specifically, the input device may be an interface between an operator and the one or more processors. The input device may include a display or touch screen, input buttons, ports for receiving memory devices, etc. In this manner, an operator may manually provide parameters into the controller, including vehicle parameters, route parameters, and trip parameters.

The output device may present information and data to an operator, or provide prompts for information and data. The output device may similarly be a display or touch screen. In this manner, a display or touch screen may be an input device and an output device.

The vehicle system may include one or more sensors 212. In one example, at least one of the sensors is a locator device utilized to determine the location of the vehicle system in relation to a switch point. The locator device may be positioned on the vehicle system, utilize wayside devices, etc. In one example, the locator device is a global navigation satellite system (GNSS) receiver, such as a global positioning system (GPS) receiver that receives signals from remote sources (e.g., satellites) for use in determining locations, movements, headings, speeds, etc., of the vehicles, and can provide position data related to the vehicle system. Alternatively, the locator device may use WiFi, Bluetooth-enabled beacons, near-field communication (NFC), radio frequency identification (RFID), QR code, etc. to provide location information.

In one example, the one or more sensors may include a switch detection device that detects the location of a switch on a route. The switch detection device may be a radar, lidar, camera, infrared camera, optical detector, communication device in communication with a communication device of the switch, or the like. The switch detection device determines when the vehicle system is in proximity to a switch for changing which route the vehicle system is traveling. In this manner, the controller may determine if a speed restriction has been provided at the switch point, including the speed restriction, and a corresponding switch type related to the speed restriction.

The vehicle controller may include a switch position application 214 that makes determinations related to the position of a switch on a route, and the switch type. In one example, when the vehicle system is a rail vehicle, the Federal Railroad Administration regulates the speed at which a rail vehicle operates over track curvatures. The regulated speed is then provided as a speed restriction during a trip that is provided in a PVC system. As a result, because the vehicle controller and PVC system can monitor the location of the vehicle system and where switches are located along a route, when a rail vehicle proceeds on a reverse leg (e.g. the switch that is transverse or curved relative to the route or leg from which the vehicle system entered the switch), an accompanying speed restriction data may be provided from the PVC system. As a result, the location data and accompanying speed restriction data can be utilized to determine or identify the position of a switch.

In addition, each different switch type may be determined, regardless of either the frog angle (e.g. angle of the track between the normal leg and reverse leg) or the length of track between a point of the switch and the half point of the frog angle correlates to a speed restriction. When used herein, the half point of the frog angle refers to a distance on a route where a reverse leg transitions into a route parallel to the normal leg. In this situation, the reverse leg measures a full distance from the switch point to the point where the route becomes parallel to the normal leg. The midway point between the switch point and the point where the route becomes parallel to the normal leg is referred to as the half point of the frog angle. Because of the correlation between the speed restriction and the switch type, the type of switch can be identified can be identified by the switch position application. In another embodiment, the turn angle of the vehicle may be used rather than the frog angle, or the distance between the start of the turn and the end of the turn, or a combination of both of the foregoing. As a simple example, an on-road vehicle navigating a round-a-bout has a different turning profile and/or distance relative to a right turn at a standard intersection.

For example, if GPS data is being utilized and/or a sensor that detects switches is being utilized, and a switch is identified as oncoming in half a mile, a determination can be made if a speed restriction is being imposed by a PVC system in the next mile. In one example, the speed restriction for the straight away on which the vehicle system is traveling may be seventy (70) miles per hour (mph). If the speed restriction drops to forty (40) mph is a defined area that includes the switch, a look up table may be utilized to determine that 40 mph correlates to maximum speed associated with a No. 20 switch type wherein a frog angle of 2.864167° is provided. Consequently, the No. 20 switch type may be identified accordingly.

The vehicle controller may communicate with a remote controller 216. The remote controller may be server, remote off-board device, back office controller, vehicle dispatch controller, or the like. In one example, the remote controller is a PVC system as described herein, and more specifically, in one embodiment a positive train control (PTC) system. The PVC system may receive characteristic information from the transceiver, determine and/or calculate the characteristic of a vehicle, calculate characteristics and parameters of the vehicle, restrict movement of the vehicle and one or more other vehicles based on a set of rules, etc.

The remote controller may include one or more processors 218 for making determinations and a memory 220 with historical data related to the vehicle, similar vehicles, the route, the trip the vehicle is undertaking, or the like. The remote controller may include a transceiver 222 for communication with the vehicle controller, and other remote controllers.

In another example, the remote controller may make determinations regarding the movement of the vehicle, and communicate such determinations to the vehicle controller. In this manner, the remote controller may restrict movement of the vehicle through communication with the vehicle controller, and restrict movement of other vehicles through communication with the vehicle controllers of the other vehicles. To this end, the remote controller may receive data related to a trip plan, determine route, route curvatures, speed restrictions, trip time, etc. that may be communicated to the vehicle controller.

Figure 3A:
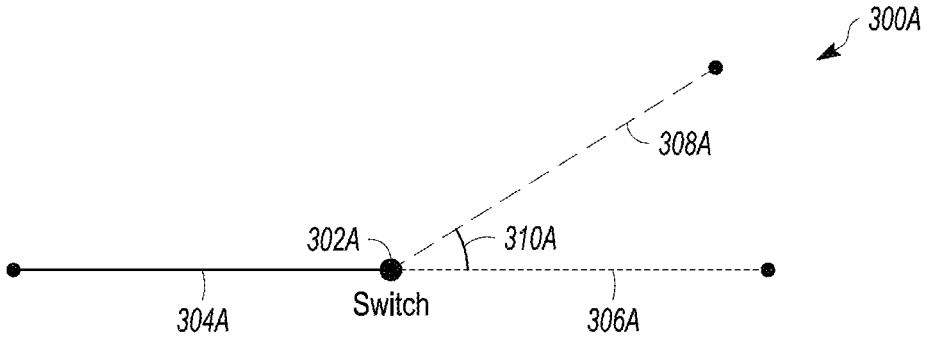
FIG. 3A illustrates a schematic of a route of a vehicle system.

FIG. 3A-3E illustrate numerous example routes 300A-300F upon which a vehicle system may travel. FIG. 3A illustrates a generic route where a vehicle system may change directions at a switch point 302A. As illustrated in FIG. 3A, the portion of the route that a vehicle system initially travels is a facing leg 304A. In an example embodiment when the vehicle system is a rail vehicle system, the facing leg is the portion of the route on which the vehicle system faces a switch, and corresponding switch point. From the switch point, if the vehicle system remains on the route, the portion of the route after the switch point is a normal leg 306A. In one example, the normal leg is the portion of the route the vehicle system traverses when no change of direction occurs. Alternatively, the portion of the route after the switch point where the vehicle system changes direction is a reverse leg 308A. The angle between the normal leg and the reverse leg is a frog angle 310A. The frog angle may vary depending upon a switch type provided at the switch point.

FIGS. 3B-3E illustrate example routes 300B-300E that include a switch point 302B-302F, facing leg 304B-204E, normal leg 306B-306E, reverse leg 308B-308E, and a frog angle 310B-310E that varies for each route. In particular, for each different frog angle, a maximum speed is provided for safely negotiating the angle. The greater the frog angle, the less the safe maximum speed. In addition, for each frog angle, the length of the reverse leg varies such that each reverse leg has a different distance of the route between the switch point and a half point of the frog angle 312B-E. In an example embodiment when a rail vehicle is provided, the switch type at each corresponding switch point is based on the frog angle, and thus may be determined based on the speed restriction. Consequently, as a result a restricted maximum speed provided at the switch point of each route is indicative of switch type provided at the switch point. In one example, a lookup table may be provided that matches the speed restriction with a switch type, including the maximum distance between the switch point and the distance of the route between the switch point and a half point of the frog angle.

Figure 3B:
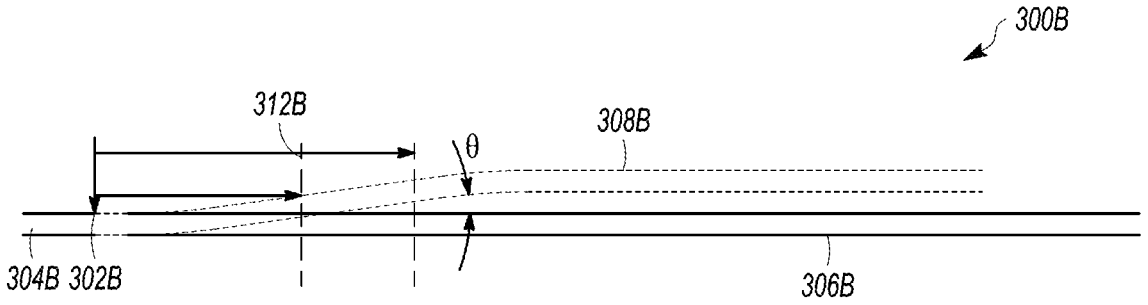
FIG. 3B illustrates a schematic of a route of a vehicle system.
Figure 3C:
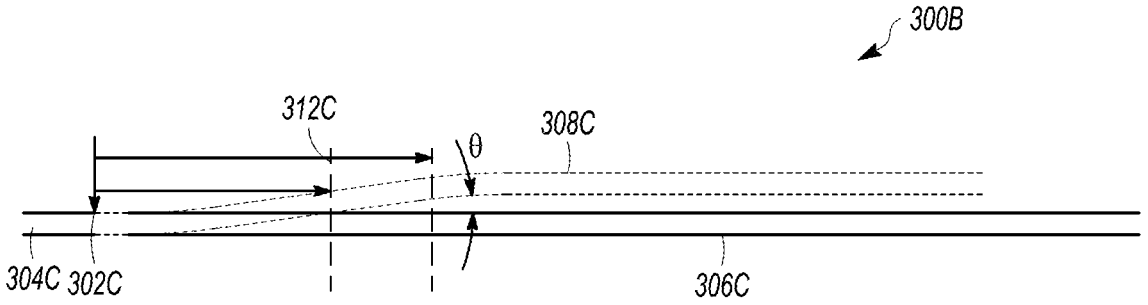
FIG. 3C illustrates a schematic of a route of a vehicle system.
Figure 3D:
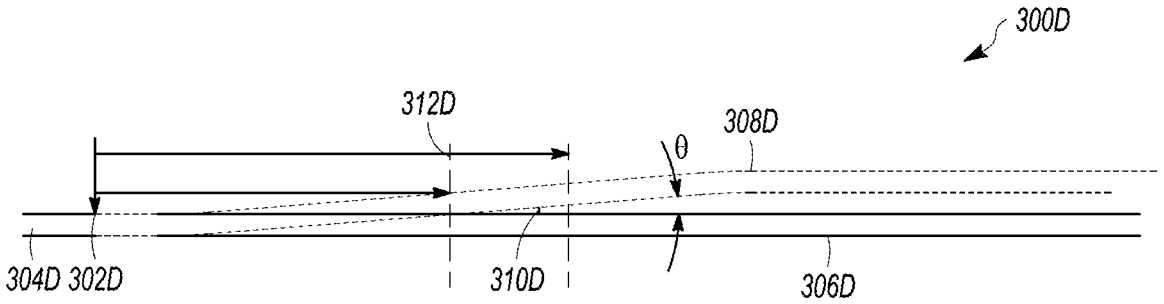
FIG. 3D illustrates a schematic of a route of a vehicle system.
Figure 3E:
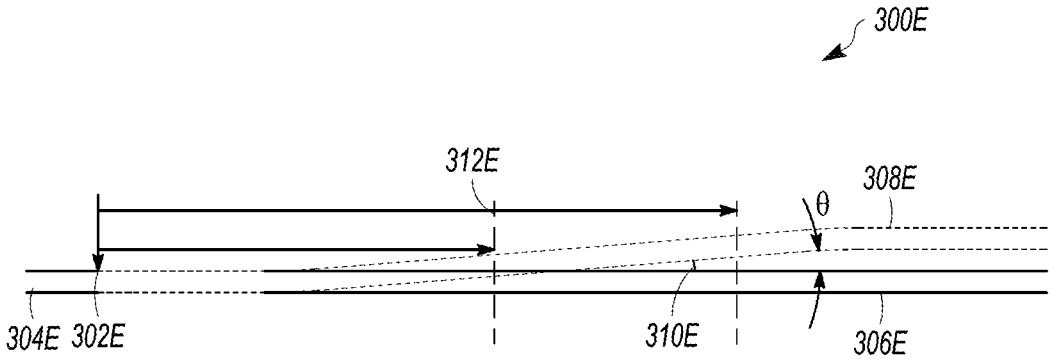
FIG. 3E illustrates a schematic of a route of a vehicle system.

Table 1 illustrated below presents the maximum frog angle, distance from point to ½ point of frog angle, and corresponding switch type (e.g. turnout type) where No. 12 is related to FIG. 3B, No. 14 is related to FIG. 3C, No. 16 is related to FIG. 3D, and No. 20 is related to FIG. 3E.

| Turnout Type | Frog Angle | Distance from Point to ½ Pt of Frog | Max Speed |
|---|---|---|---|
| No. 8 | 7.152778° | 68 feet | 10 mph |
| No. 10 | 5.724722° | 80 feet | 15 mph |
| No. 12 | 4.771944° | 98 feet | 15-20 mph |
| No. 14 | 4.090833° | 111 feet | 30 mph |
| No. 16 | 3.579722° | 139 feet | 30 mph |
| No. 20 | 2.864167° | 167 feet | 40 mph |
| No. 24 | 2.386944° | | 50 mph |

As a result, a lookup table can be provided, where a switch position application only needs to determine that a change in speed restriction has occurred to one of the maximum speeds listed to determine the switch type. In one example, a rail vehicle has a maximum speed restriction of 70 mph until coming upon a determined area with a switch. In the determined area with the switch, the maximum speed restriction is reduced to 40 mph. Based on table 1, a switch position application not only is able to determine that rail vehicle is taking the reverse leg at the switch, but in addition, that the switch type is a No. 20. In this manner, the switch position application not only determines the switch position, but additionally identifies the switch type to be utilized as part of the database of the monitoring remote controller.

In particular, by identifying the switch type, the switch type can be saved within the database of the vehicle controller, a remote off-board controller, a PVC system, etc. While having each switch type in the network of preexisting tracks manually determined and inputted may be intensive, by having a switch application identify each switch automatically as the rail vehicle system utilizes the reverse leg, such database can be easily compiled without need for manual inputs. Consequently, vehicle controllers may use the methodology described herein to determine the switch type, and a heading methodology to verify the switch type.

While the example embodiments of FIGS. 3A-3F appear as tracks for a rail vehicle system, in other embodiment, other routes and vehicle systems may utilize a similar methodology to determine a direction a vehicle system is headed. For example, for an autonomous vehicle, including automobiles, trucks, etc. that travel along a highway, a speed restriction at a switch point that can be either an on ramp or off ramp may be indicative of the type of existing ramp provided. In one example, a determination may be made that at a switch point a cloverleaf type of exit ramp is provided instead of a non-cloverleaf exit ramp. This determination can than assist in analysis of potential traffic, labeling highway maps, driving maneuvers, or the like. To this end, other vehicle systems, including autonomous vehicle systems may utilize the methodology herein to determine a route of a vehicle system during a trip and identify routes for an existing map.

Figure 4:
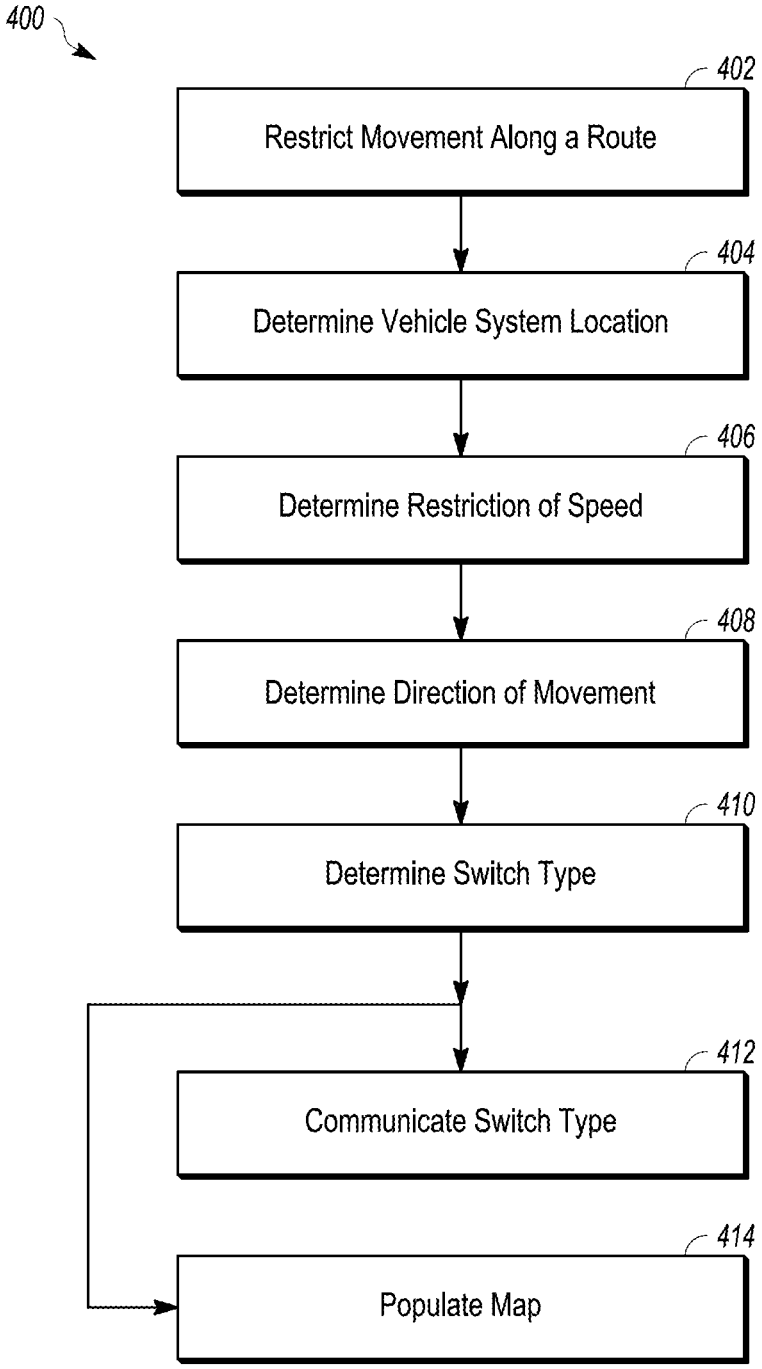
FIG. 4 illustrates a block schematic diagram of a method of determining a switch type at a switch point along a route of a vehicle system.

FIG. 4 illustrates a block diagram of a method 400 of determining a switch type along a route. Switch type refers herein to a change (e.g. switch) in a route from a pathway, and the geometry and characteristics associated with the path of the route taken by a vehicle system to the path of the route not taken by the vehicle system. Therefore, while a switch may refer to a device that causes a rail vehicle to move from one track to another track, a switch point, and corresponding switch type as used herein can relate to any change in route for any vehicle system depending on context. For example, if an automobile is traveling down a highway and utilizes an exit ramp, the geometry and characteristics associated with the continuing highway and the exit ramp itself present a way to provide a switch type. For an airplane, when the airplane is traveling in a straight path and then circles for a landing, the geometry and characteristics between the continued straight path and the curved path can be utilized to determine and define a switch type. Other vehicle systems similarly can provide switch types accordingly.

The method in one example may at least in part be implemented by the vehicle controller as provided in relation to FIG. 2. In another example, the method may in part at least be implemented by the remote controller as described in relation to FIG. 2. In another example, the route, switch point, and switch type are illustrated in the example embodiments of FIGS. 2A-2E and table 1 is utilized at least in part as a lookup table. In yet another example, the vehicle system of the method can be the vehicle system as illustrated in FIG. 1.

At step 402, a controller, restricts movement of a vehicle system along a route. In one example, the controller is a vehicle controller that obtains communications from a remote PVC controller related to the movement of the vehicle system. In another example, the controller may be a remote controller that in one embodiment can be a PVC controller that communicates information and data, including speed restrictions to a vehicle controller. In addition, movement may be considered restricted when a vehicle system does not move as fast as the vehicle system is capable of moving. For example, if a vehicle system is moving at a straight line speed of 70 miles per hour (mph), and the vehicle system comes upon a residential area causing the straight line speed to be reduced to 30 mph, the movement is considered restricted. Similarly, if the vehicle system is moving at a straight line speed of 70 mph, and the vehicle system comes upon a curve in the route resulting in a reduction of speed to 50 mph to safely navigate the curve, a restriction in movement is provided. In other examples changing a route, an accident on a route, traffic on a route, coming upon a traffic signal, coming upon a station, terminal, etc., coming to a drop point or pick up point, or the like can all result in restrictions in movement of the vehicle system.

In one example, the controller includes a PVC controller, communicates with a PVC controller, is a PVC controller, etc. that determines when restrictions of movement occur. In particular, the PVC controller may not only obtain a trip plan or other trip information related to the vehicle system, but additionally vehicle system information related to numerous vehicle systems traveling along a network or routes. In this manner, the movement of the vehicle system can depend on the route itself, the vehicle condition, other vehicle systems, environmental factors, constraints provided externally, etc.

At step 404, a location of the vehicle system is determined in relation to a switch point. In one example, the controller is a vehicle controller that includes a location device as described in relation to the FIG. 2. The switch point may be the location at which a route splits from an original route to allow the vehicle system to change directions. The switch point in one example includes a switch located in proximity of the switch point. The switch may be detected by sensors in communication with the vehicle controller. The sensors may be utilized to determine the location of the switch and the distance between the switch, and corresponding switch point, and the vehicle system. Alternatively, based on a trip plan, map of the route, etc. the vehicle controller may be provided the location of the switch point prior to, or during a trip.

At step 406, a restriction of speed of the vehicle system is determined in relation to the switch point. In one example, when a vehicle system is set to change routes at a switch point and a PVC controller is provided, a restriction in the speed of the vehicle system to safely negotiate the change in route is provided. The change in speed correlates to the geometry, angle, route characteristics, etc. of the new route compared to the original route. For example, the greater the angle, the more the speed is restricted. The characteristics may include frog angle, route curvature, route shape, distance of the route between the switch point and a half point of the frog angle, distance before another change in direction, size of the vehicle system in comparison to any of the other characteristics listed, length of the vehicle system in comparison to any of the other characteristics listed, or the like.

At step 408, the direction of movement of the vehicle system is determined based on the restriction in the speed at the switch point. In one example, a PVC controller provides a speed restriction based on the vehicle system changing routes at the switch point. Based on the frog angle and distance at a half point of the frog angle, a maximum speed is provided that is less than the maximum speed of the vehicle prior to the switch point. In one example if the maximum speed is reduced, a determination is made that the vehicle system is changing directions at the switch point.

At step 410, a determination is made related to the switch type at the switch point. In one example, the restricted speed is compared to a determined speed related to a switch type. In an example, a lookup table is provided that includes the maximum restricted speed and a switch type. In yet another example, the lookup table includes at least a portion of Table 1. In particular, in one embodiment, the switch type is based on at least one of a frog angle, or a distance of the route between the switch point and a half point of the frog angle.

At step 412, optionally, the switch type determined may be communicated to a remote controller. In one example, the switch type is communicated to a PVC controller that is at a remote location such as a dispatch, station, monitoring location, or the like.

At step 414, a map that includes the route is populated with the switch type at the switch point. In one example, when the switch type is communicated to a PVC controller as described in relation to step 412, the PVC controller includes a map with numerous routes. The PVC controller communicates with numerous vehicle controllers of numerous vehicle systems utilizing the routes. In this manner, when another vehicle system utilizes the system route, and same switch point, the switch type will already be populated in the map. In this manner, the vehicle controller or remote controller need only to verify the switch type. In another example, the map may be within the memory of the vehicle system itself. In either example, once the switch type is identified, the process for identifying the switch type may no longer be implemented to save memory space, processing space, etc.

In one or more embodiments, a system is provided that may include a controller having one or more processors. The one or more processors may control movement of a vehicle system along a route, and determine a restriction in speed of the vehicle system at a switch point. The one or more processors may determine a direction of movement of the vehicle system based on the restriction in the speed at the switch point.

Optionally, the one or more processors may compare the restriction in the speed of the vehicle system to determined speeds related to switch types. In one example, the one or more processors determine a switch point location on the route, and determine a switch type based on the restriction in the speed of the vehicle system at the switch point location. In one aspect, the one or more processors determine the switch type based on at least one of (a) a frog angle or (b) a distance of the route between the switch point and a half point of the frog angle. In another aspect, the one or more processors populate a map at the switch point with the switch type that is determined. In one example, the one or more processors communicate the switch type that is determined to a remote controller. In another example, the vehicle system is a rail vehicle. In one embodiment, the one or more processors restrict the movement of the vehicle system based on communications from a positive vehicle controller.

In one or more embodiments, a method is provided and may include receiving, with a vehicle controller, communication from a positive vehicle controller at a remote location, and determining a restriction in speed of a vehicle system at a switch point on a route based on the communication from the positive vehicle controller. The method may include determining a direction of movement of the vehicle system at the switch point based on the restriction in the speed at the switch point.

Optionally, determining the direction of the movement of the vehicle system at the switch point may include comparing the restriction in the speed of the vehicle system to determined speeds related to switch types. In one aspect, the method may include determining, with the vehicle controller, a location of the switch point based on the communication from the positive vehicle controller. In another aspect, the method may include determining a switch type based on the restriction in the speed of the vehicle system at the switch point. Optionally, determining the switch type may include obtaining, with the vehicle controller, at least one of (a) a frog angle or (b) a distance of the route between the switch point and a half point of the frog angle. In one example, the method may include communicating the switch type from the vehicle controller to the positive vehicle controller for populating a map that includes the route.

In one or more embodiments a system is provided that may include a vehicle system with a vehicle controller having one or more processors. The one or more processors may receive communications from a positive vehicle controller remote from the vehicle system related to a restriction in speed of the vehicle system, and obtain the restriction in the speed of the vehicle system at a determined location on a route. The one or more processors may determine a direction of movement of the vehicle system at the determined location based on the restriction in the speed at the determined location of the route.

Optionally, the determined location may be a switch point location between a normal leg of the route and a reverse leg of the route. In one aspect, the one or more processors may compare the restriction in the speed of the vehicle system to determined speeds related to switch types and may determine a switch type at the determined location based at least in part on the restriction in the speed of the vehicle system at the determined location. In another aspect, the switch type may be based on at least one of (a) a frog angle or (b) a distance of the route between the switch point and a half point of the frog angle. In one example, the one or more processors may communicate the switch type determined to the positive vehicle controller. In another example, the one or more processors may restrict the movement of the vehicle system based on the communications from the positive vehicle controller.

In one embodiment, the control system, or controller, may have a local data collection system deployed and may use machine learning to enable derivation-based learning outcomes. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. The tasks may be machine learning problems such as classification, regression, clustering, density estimation, dimensionality reduction, anomaly detection, and the like. In examples, machine learning may include a plurality of mathematical and statistical techniques. The machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components are restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and control, behavior analytics, and the like.

In one embodiment, controller may include a policy engine that may apply one or more policies. These policies may be based at least in part on characteristics of a given item of equipment or environment. With respect to control policies, a neural network can receive input of a number of environmental and task-related parameters. The neural network can be trained to generate an output based on these inputs, with the output representing an action or sequence of actions that the vehicle should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes. These may be weighed relative to each other.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

a controller having one or more processors configured to:

control movement of a vehicle system along a route;

determine a change in speed of the vehicle system at a switch point; and determine a switch type at the switch point based on the change in the speed at the switch point.

2. The system of claim 1, wherein the one or more processors are further configured to compare the change in the speed of the vehicle system to determined speeds related to switch types.

3. The system of claim 1, wherein the one or more processors are configured to determine the switch type based on at least one of (a) a frog angle or (b) a distance of the route between the switch point and a half point of the frog angle.

4. The system of claim 1, wherein the one or more processors are further configured to:

populate a map at the switch point with the switch type that is determined.

5. The system of claim 1, wherein the one or more processors are further configured to communicate the switch type that is determined to a remote controller.

6. The system of claim 1, wherein the vehicle system is a rail vehicle.

7. The system of claim 1, wherein the one or more processors are further configured to restrict the movement of the vehicle system based on communications from a positive vehicle controller.

8. The system of claim 1, wherein the one or more processors are further configured to adjust a vehicle control setting based on the switch type.

9. The system of claim 8, wherein the vehicle control setting comprises at least one of a throttle setting or a dynamic braking setting.

10. A method comprising:

receiving, with a vehicle controller, communication from a positive vehicle controller at a remote location;

determining a change in speed of a vehicle system at a switch point on a route based on the communication from the positive vehicle controller; and determining a direction of movement of the vehicle system at the switch point based on the change in the speed at the switch point.

11. The method of claim 10, wherein determining the direction of the movement of the vehicle system at the switch point includes comparing the change in the speed of the vehicle system to determined speeds related to switch types.

12. The method of claim 10, further comprising:

determining, with the vehicle controller, a location of the switch point based on the communication from the positive vehicle controller.

13. The method of claim 12, further comprising:

determining a switch type based on the change in the speed of the vehicle system at the switch point.

14. The method of claim 13, wherein determining the switch type includes obtaining, with the vehicle controller, at least one of (a) a frog angle or (b) a distance of the route between the switch point and a half point of the frog angle.

15. The method of claim 14, further comprising communicating the switch type from the vehicle controller to the positive vehicle controller for populating a map that includes the route.

16. A system comprising:

a vehicle system with a vehicle controller having one or more processors configured to:

receive communications from a positive vehicle controller remote from the vehicle system related to a change in speed of the vehicle system;

obtain the change in the speed of the vehicle system at a determined location on a route; and determine a switch type at a switch point at the determined location based on the change in the speed at the determined location on the route.

17. The system of claim 16, wherein the determined location is a switch point location between a normal leg of the route and a reverse leg of the route.

18. The system of claim 16, wherein the one or more processors are further configured to:

compare the change in the speed of the vehicle system to determined speeds related to switch types.

19. The system of claim 18, wherein the switch type is based on at least one of (a) a frog angle or (b) a distance of the route between a switch point and a half point of the frog angle.

20. The system of claim 18, wherein the one or more processors are further configured to communicate the switch type determined to the positive vehicle controller.

21. The system of claim 16, wherein the one or more processors are further configured to restrict movement of the vehicle system based on the communications from the positive vehicle controller.

* * * * *